US006618893B1

(12) United States Patent
Wang

(10) Patent No.: US 6,618,893 B1
(45) Date of Patent: Sep. 16, 2003

(54) HAIRBRUSH WITH BRISTLES RETAINED ON A FLEXIBLE PAD BODY

(76) Inventor: Huo-Pia Wang, No. 9-2, Alley An-Tou, Yen-Ping Li, Chang-Hua City (TW)

( * ) Notice: Subject to any disclaimer, the term of this patent is extended or adjusted under 35 U.S.C. 154(b) by 0 days.

(21) Appl. No.: 10/144,368

(22) Filed: May 13, 2002

(51) Int. Cl.[7] ..... A46B 15/00
(52) U.S. Cl. ..... 15/186; 132/152
(58) Field of Search ..... 132/141, 142, 132/152, 154, 156, 158, 162; 15/186, 201

(56) References Cited

U.S. PATENT DOCUMENTS 3,739,419 A * 6/1973 Natman et al. ..... 15/187
5,095,892 A * 3/1992 Tsumura ..... 60/137
5,435,032 A * 7/1995 McDougall ..... 15/22.1
5,974,619 A * 11/1999 Weihrauch ..... 15/186

* cited by examiner

*Primary Examiner*—Kevin Shaver
*Assistant Examiner*—Stephanie Willatt
(74) *Attorney, Agent, or Firm*—Hoffmann & Baron, LLP

(57) ABSTRACT

A hairbrush includes a flexible pad body formed integrally from a flexible material, and a plurality of bristles, each having an enlarged head portion retained on the pad body at a respective one of bristle-retention blind holes in the pad body. The top surface of the pad body is formed with a groove unit to form a spacing between the enlarged head portions of adjacent ones of the bristles in at least a transverse direction transverse to a longitudinal direction of the pad body.

6 Claims, 4 Drawing Sheets

HAIRBRUSH WITH BRISTLES RETAINED ON A FLEXIBLE PAD BODY

BACKGROUND OF THE INVENTION

1. Field of the Invention

The present invention relates to a hairbrush with bristles retained on a flexible pad body, more particularly to a hairbrush with a pad body for the bristles retained on a flexible pad body.

2. Description of the Related Art

Referring to FIG. 1, a conventional hairbrush 10 is shown to include a handle body 11, a flexible pad body 12 mounted on one end ill of the handle body 11, and a plurality of bristles 13. As illustrated, the pad body 12 is formed with a plurality of through holes 121, and a net layer 132 is disposed on a top side 122 of the pad body 12. Each of the bristles 13 has an enlarged head portion 132 retained at a space between the net layer 123 and the top side 122 of the pad body 12, and a slender bristle segment 131 that extends from the enlarged head portion 132 and through holes 121 in the pad body 12. Because the pad body 12 is formed from a flexible material, the bristles 13 can conform to the contour of the user's head. However, due to the accumulation of moisture within the space between the handle body 11 and the pad body 12, the structural strength of the net layer 123 tends to be degraded after the hairbrush 10 has been in use for a period of time. Thus, the head portions 123 of the bristles 13 tend to pierce through the net layer 123 such that the bristles 13 are movable in the through holes 121. Consequently, the hairbrush 10 has a relatively short service life in view of aforementioned drawback.

SUMMARY OF THE INVENTION

The object of the present invention is to provide a hairbrush with bristles that are retained on a flexible pad body in a manner which is clear of the aforementioned drawback that generally results from the use of the conventional hairbrush.

Accordingly, the hairbrush of the present invention includes a flexible pad body formed integrally from a flexible material, and a plurality of bristles. Each bristle is formed with an enlarged head portion and a slender bristle segment extending from the enlarged head portion. The pad body extends in a longitudinal direction, and has a top surface and a bottom surface opposite to the top surface in a vertical direction. The bottom surface is formed with a plurality of bristle-retention blind holes that extend in the vertical direction toward the top surface. Each bristle-retention blind hole has an open end adjacent to the bottom surface, a closed end opposite to the open end, a small-diameter hole portion adjacent to the open end, and a large-diameter hole portion adjacent to the closed end. The large-diameter hole portion is larger than the small-diameter hole portion. Each bristle is retained on the pad body at a respective one of the bristle-retention blind holes such that the enlarged head portion is disposed in the large-diameter hole portion and is prevented from removal therefrom by the small-diameter hole portion, and such that the slender bristle segment extends out of the respective one of the bristle-retention blind holes via the small-diameter hole portion. The top surface of the pad body is formed with a groove unit to form a spacing between the enlarged head portions of adjacent ones of the bristles in at least a transverse direction transverse to the longitudinal direction.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
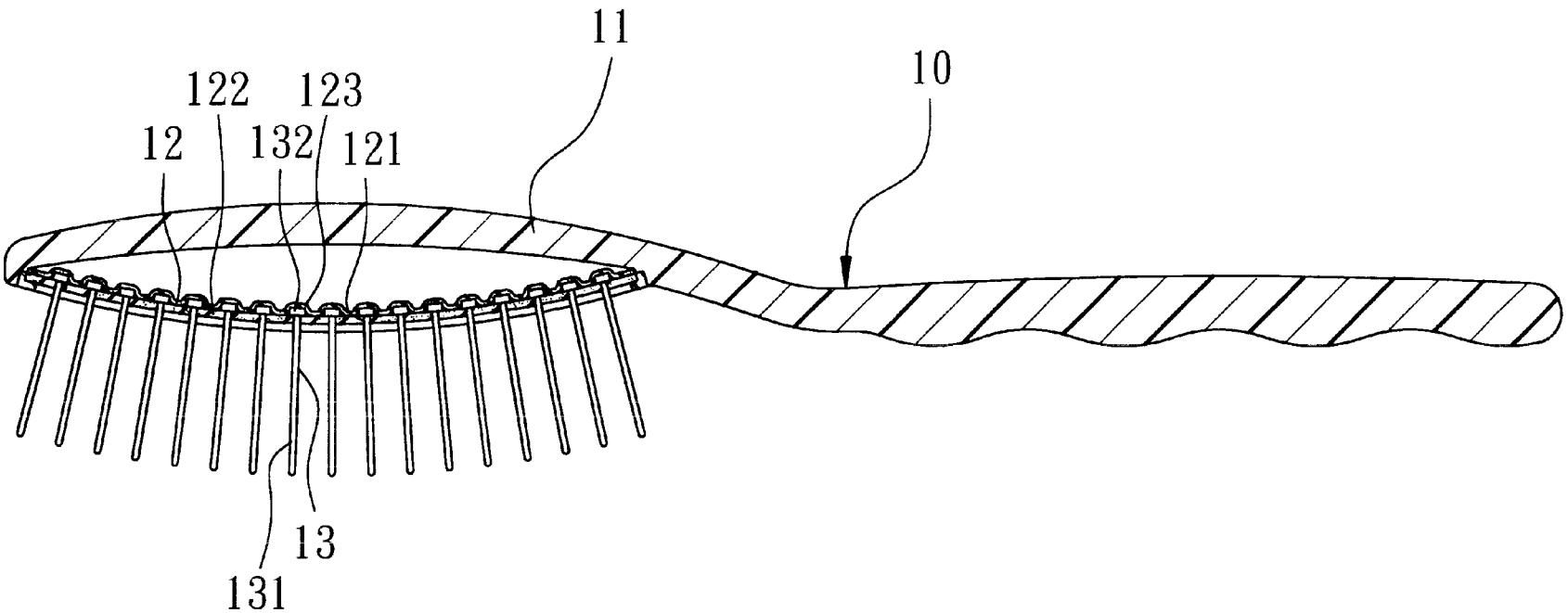
FIG. 1 PRIOR ART
FIG. 1 is a longitudinal sectional view of a conventional hairbrush.
Figure 2:
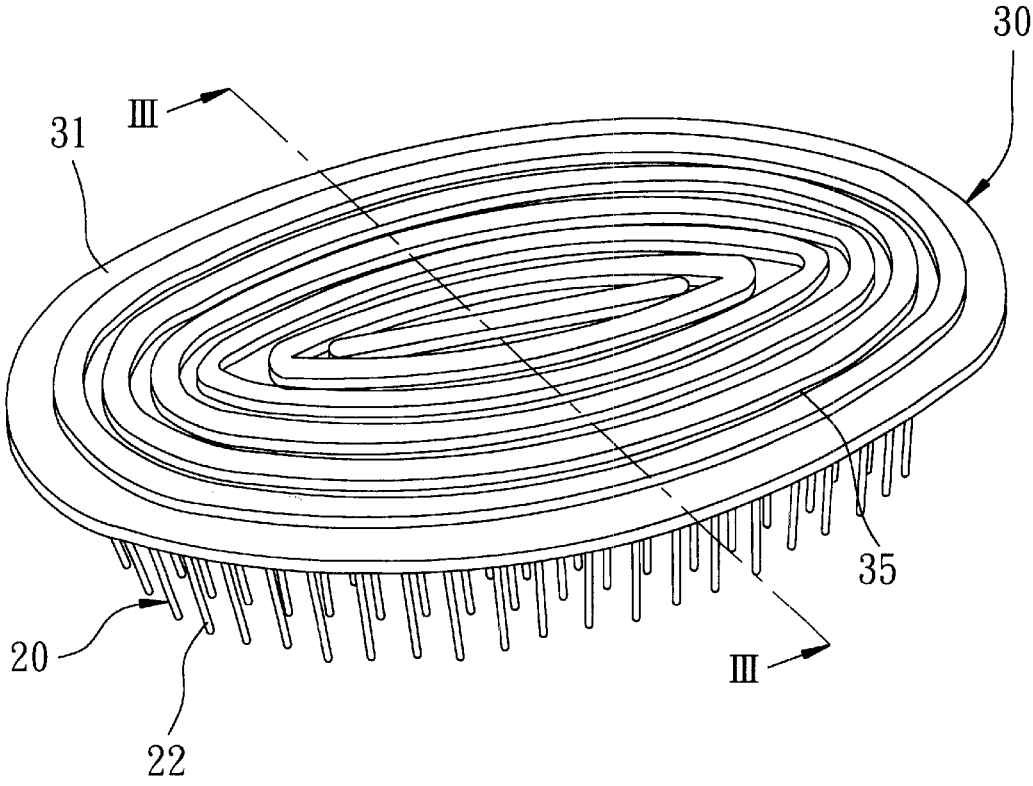
FIG. 2 is a fragmentary perspective view of the first preferred embodiment of a hairbrush according to the present invention.
Figure 3:
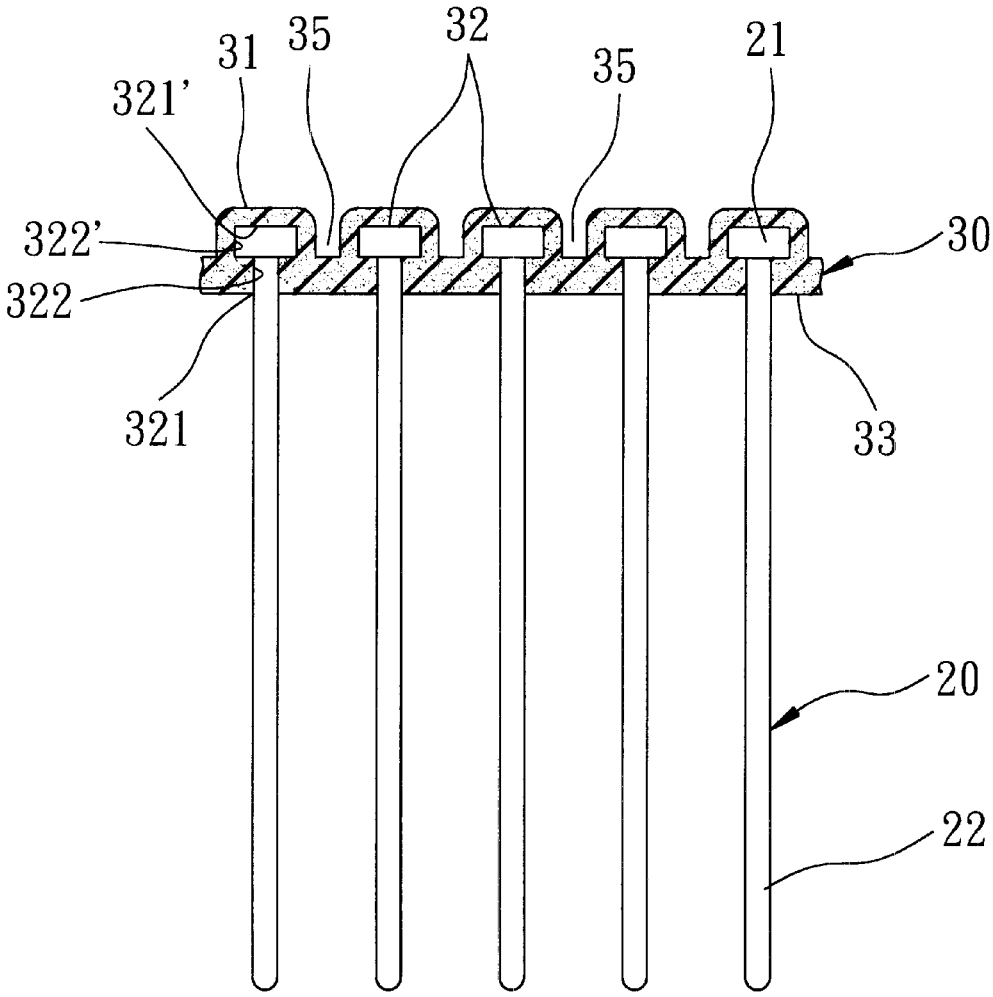
FIG. 3 is a cross-sectional view taken along line III—III of FIG. 2.

Referring to FIGS. 2 and 3, the first preferred embodiment of a hairbrush according to the present invention is shown to include a flexible pad body 30 formed integrally from a flexible material, such as rubber, and a plurality of bristles 20, such as metal bristles.

As illustrated, each bristle 20 is formed with an enlarged head portion 21 and a slender bristle segment 22 extending from the enlarged head portion 21.

The pad body 30 extends in a longitudinal direction, and has a top surface 31 and a bottom surface 33 opposite to the top surface 31 in a vertical direction. The bottom surface 33 is formed with a plurality of bristle-retention blind holes 32 that extend in the vertical direction toward the top surface 31. Each of the bristle-retention blind holes 32 is formed with an open end 321 adjacent to the bottom surface 33, a closed end 321' opposite to the open end 321, a small-diameter hole portion 322 adjacent to the open end 321, and a large-diameter hole portion 322' adjacent to the closed end 321', wherein the large-diameter hole portion 322' is larger than the small-diameter hole portion 322.

Each of the bristles 20 is retained on the pad body 30 at a respective one of the bristle-retention blind holes 32 such that the enlarged head portion 21 is disposed in the large-diameter hole portion 322' and is prevented from removal therefrom by the small-diameter hole portion 322, and such that the slender bristle segment 22 extends out of the bristle-retention blind holes 32 via the small-diameter hole portion 322.

Preferably, an injection molding operation is performed upon the enlarged head portions 21 of the bristles 20 to form the pad body 30. The rubber material from which the pad body 30 is formed is moisture-resistant.

The top surface 31 of the pad body 30 is formed with a groove unit 35 to form a spacing between the enlarged head portions 21 of adjacent ones of the bristles 20 in a transverse direction transverse to the longitudinal to direction. In this embodiment, the groove unit 35 includes a plurality of concentric grooves, as best shown in FIG. 2. In view of the groove unit 35, flexibility of the pad body 30 can be enhanced such that the bristles 20 can closely conform to the contour of the user's head.

Figure 4:
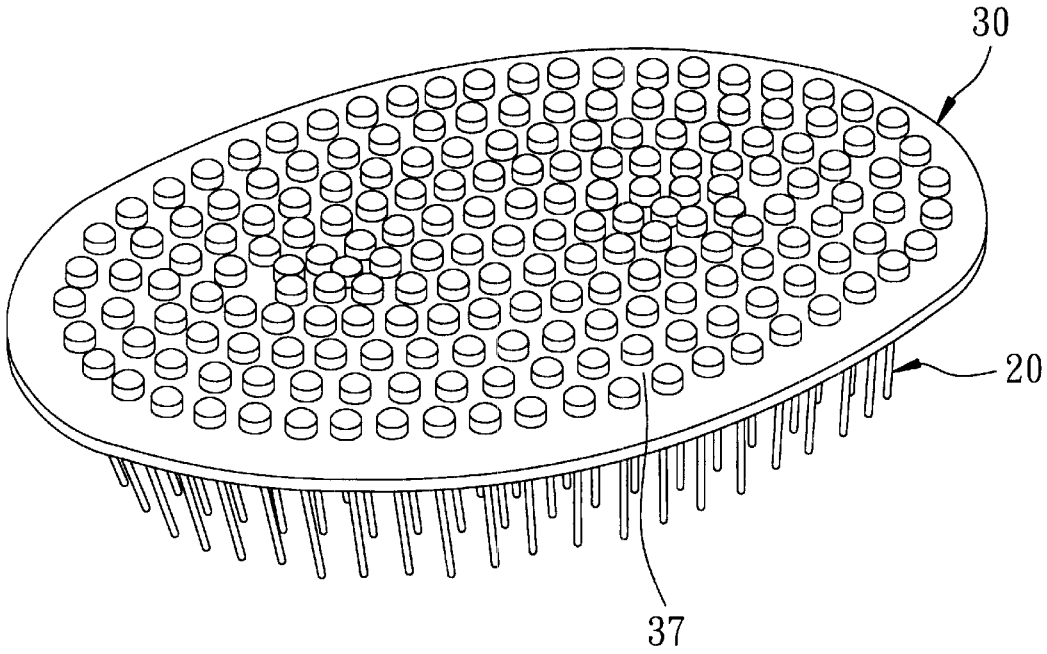
FIG. 4 is a fragmentary perspective view of the second preferred embodiment of a hairbrush according to the present invention.

Referring to FIG. 4, in the second preferred embodiment of a hairbrush of the present invention, the groove unit 37 is configured to form the spacing between the enlarged head portions 21 of the adjacent ones of the bristles 20 in both the longitudinal and transverse directions.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A hairbrush comprising:

a plurality of bristles, each of which has an enlarged head portion, and a slender bristle segment extending from said enlarged head portion; and a pad body formed integrally from a flexible material, said pad body extending in a longitudinal direction, and having a top surface and a bottom surface opposite to said top surface in a vertical direction, said bottom surface being formed with a plurality of bristle-retention blind holes that extend in the vertical direction toward said top surface, each of said bristle-retention blind holes having an open end adjacent to said bottom surface, a closed end opposite to said open end, a small-diameter hole portion adjacent to said open end, and a large-diameter hole portion adjacent to said closed end, said large-diameter hole portion being larger than said small-diameter hole portion;

each of said bristles being retained on said pad body at a respective one of said bristle-retention blind holes such that said enlarged head portion is disposed in said large-diameter hole portion and is prevented from removal therefrom by said small-diameter hole portion, and such that said slender bristle segment extends out of the respective one of bristle-retention blind holes via said small-diameter hole portion;

said top surface of said pad body being formed with a groove unit to form a spacing between said enlarged head portions of adjacent ones of said bristles in at least a transverse direction transverse to the longitudinal direction.

2. The hairbrush as claimed in claim 1, wherein said pad body is formed integrally by injection molding.

3. The hairbrush as claimed in claim 1, wherein said pad body is made of rubber.

4. The hairbrush as claimed in claim 3, wherein said bristles are made of metal.

5. The hairbrush as claimed in claim 1, wherein said groove unit includes a plurality of concentric grooves.

6. The hairbrush as claimed in claim 1, wherein said groove unit further forms the spacing between said enlarged head portions of the adjacent ones of said bristles in the longitudinal direction.

* * * * *